US011698607B2

(12) United States Patent
Haering et al.

(10) Patent No.: US 11,698,607 B2
(45) Date of Patent: Jul. 11, 2023

(54) ORIENTABLE BACK FOR A TIMEPIECE

(71) Applicant: BLANCPAIN S.A., Le Brassus (CH)

(72) Inventors: Yann Haering, Vicques (CH); Sebastien Jobez, Boron (CH); Nicolas Debaud, Puidoux (CH)

(73) Assignee: BLANCPAIN S.A., Le Brassus (CH)

( * ) Notice: Subject to any disclaimer, the term of this patent is extended or adjusted under 35 U.S.C. 154(b) by 563 days.

(21) Appl. No.: 16/735,948

(22) Filed: Jan. 7, 2020

(65) Prior Publication Data

US 2020/0218201 A1 Jul. 9, 2020

(30) Foreign Application Priority Data

Jan. 9, 2019 (EP) ..... 1915103

(51) Int. Cl.
*G04B 45/00* (2006.01)
*G04B 37/11* (2006.01)

(52) U.S. Cl.
CPC ..... *G04B 45/0084* (2013.01); *G04B 37/11* (2013.01)

(58) Field of Classification Search
CPC . G04B 37/11; G04B 45/0084; G04B 45/0092
See application file for complete search history.

(56) References Cited

U.S. PATENT DOCUMENTS 5,923,622 A 7/1999 Chung
7,324,410 B1 * 1/2008 Ziv ..... G04B 45/0084 368/283
8,142,069 B2 * 3/2012 Muller ..... G04B 37/00 368/310
2003/0016591 A1 * 1/2003 Meyrat ..... G04B 37/0033 368/309
2008/0043577 A1 * 2/2008 Mavilla ..... G04B 37/0008 368/310
2012/0311862 A1 * 12/2012 Knuchel ..... G04B 37/005 29/896.3
2018/0032034 A1 * 2/2018 Vuille ..... G04B 47/04

FOREIGN PATENT DOCUMENTS

CH 243389 A * 7/1946
CN 1734375 A 2/2006
CN 101126914 A 2/2008
(Continued)

OTHER PUBLICATIONS

Luthy, Edouard, English Translation of CH 243389, originally published on Jul. 15, 1946, retrieved from Espacenet on Oct. 12, 2022, full document (Year: 1946).*
(Continued)

*Primary Examiner* — Daniel P Wicklund
(74) *Attorney, Agent, or Firm* — Sughrue Mion, PLLC

(57) ABSTRACT

A back (1) for a watch case (50), the back (1) including a first element (10) arranged so as to be screwed onto the watch case (50), and a second element (20) including an end face bearing a pattern (M), the second element (20) being mounted such that it can move in rotation about an axis (C) passing through the centre of the case (50), wherein the second element (20) has a brake arranged so as to hold same relative to the first element (10) in different angular positions about the rotational axis (C), the brake being disposed between the first and second elements (10, 20).

12 Claims, 4 Drawing Sheets

(56) References Cited

FOREIGN PATENT DOCUMENTS

| | | | |
|---|---|---|---|
| CN | 101258451 | A | 9/2008 |
| CN | 204287754 | U | 4/2015 |
| CN | 105278317 | A | 1/2016 |
| EP | 1278108 | A1 | 1/2003 |
| EP | 1 760 556 | A1 | 3/2007 |
| EP | 1 890 203 | A1 | 2/2008 |
| JP | 11-118954 | A | 4/1999 |
| JP | 2008-46131 | A | 2/2008 |

OTHER PUBLICATIONS

Communication dated Nov. 4, 2020 by the Japanese Patent Office in application No. 2019-233841.
Communication dated Jan. 26, 2021, from the China National Intellectual Property Administration in application No. 202010017655.5.
European Search Report for EP 19 15 1038, dated Jul. 23, 2019.

* cited by examiner

A - A

B - B

ORIENTABLE BACK FOR A TIMEPIECE

The present invention relates to backs for timepieces and more particularly to such backs including a pattern or a logo on the external face thereof and wherein said pattern or logo can be oriented as desired.

CROSS REFERENCE TO RELATED APPLICATIONS

This application is a Utility Application, claiming priority based on European Patent Application No. 19151038.7 filed Jan. 9, 2019.

TECHNOLOGICAL BACKGROUND

It is often the case that, when screwing a watch case back onto the middle part thereof, it is observed that, when the back is fully screwed in, the decorative patterns or inscriptions that may have been, for example, stamped or etched on the face of the back situated on the same side as the wrist of the individual wearing the watch, are not properly aligned relative to the 12 o'clock-6 o'clock vertical axis of said watch which, it goes without saying, is detrimental to the aesthetics of this watch.

This aesthetic defect, which may be tolerable for low-cost watches, constitutes a very significant drawback for more expensive watches.

In order to overcome this drawback, the only known solution to date consists of pairing a back with a determined watch case during machining, so as to ensure that once fully screwed in, the back is perfectly aligned with the 12 o'clock-6 o'clock axis of the watch. However, this solution is not very satisfactory since this creates problems in the event that the original back of the watch is lost or damaged and must be replaced by another back, for which it cannot be guaranteed that once screwed on the middle part, it will be properly aligned with the 12 o'clock-6 o'clock vertical axis.

SUMMARY OF THE INVENTION

The purpose of the present invention is to overcome this drawback, in addition to other drawbacks, by proposing a system enabling, after screwing a back onto the middle part of a watch case, the orientation of the back to be adjusted in a simple and effective manner relative to the watch, so as to guarantee the proper disposition of the inscriptions and other decorative patterns that have been inscribed on the face of the back of the watch directed towards the wrist of the individual wearing this watch.

For this purpose, the present invention relates to a back for a watch case, the back comprising a first element arranged so as to be screwed onto the watch case, and a second element including an end face bearing a pattern, the second element being mounted such that it can move in rotation about an axis passing through the centre of the case, characterised in that the second element comprises braking means arranged so as to hold same relative to the first element in different angular positions about the rotational axis, the braking means being disposed between the first and second elements.

Thanks to these features, the present invention provides a device for fastening a watch case back which enables the full screwing of this back to the middle part of the watch to ensure the sealing thereof and to prevent, as far as possible, any risk of losing said back, then, even though the back is fully screwed in place, which enables a movable element of this back to be pivoted relative to the middle part in order to make up for a potential misalignment of the inscriptions or patterns applied to the visible face of said back.

According to other advantageous alternative embodiments of the invention:

- said braking means act by friction;
- said braking means include at least one elastic annular element;
- said at least one annular element is elastic in a direction parallel to the rotational axis of the second element;
- said braking means are formed by a ring gasket made of a compressible material;
- the first element and the second element comprise complementary clipping means;
- the second element comprises a pin arranged such that it engages with an annular groove formed in the first element;
- the second element comprises two elastic annular elements housed inside first and second annular slots facing one another and formed in the first element;
- said annular slots are disposed on either side of the circular groove;
- the second annular slot has two levels, a first level forming the bottom and arranged so as to receive an elastic annular element, and a second level arranged so as to receive the edge of the second element;
- an O-ring is inserted into an annular groove made in the bottom of the watch case in order to guarantee sealing between the back and said case.

The invention further relates to a timepiece comprising a moon phase mechanism according to the invention.

BRIEF DESCRIPTION OF THE FIGURES

The purposes, advantages and features of the striking watch will appear more clearly in the following description which is given on the basis of at least one non-limiting embodiment shown by way of the drawing, in which.

DETAILED DESCRIPTION

Figure 1:
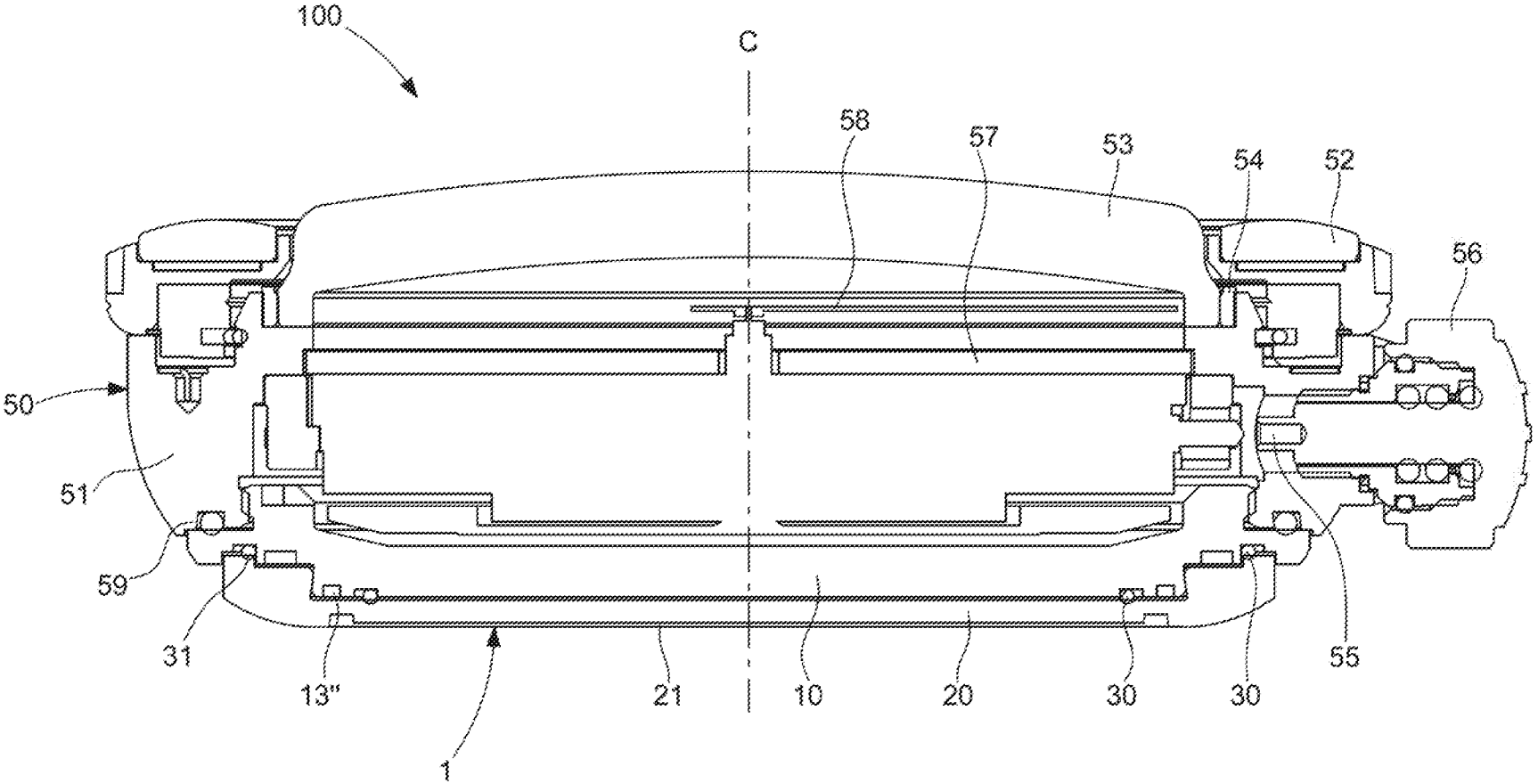
FIG. 1 is a sectional view of a watch case provided with a back according to the invention.

FIG. 1 shows a back 1 for a watch case 50 intended to be screwed by a screw pitch onto a middle part 51, the latter having a complementary threading machined at the bottom thereof and on the inner circumference thereof.

More specifically, the back 1 comprises a first element 10 arranged such that it is screwed onto the watch case 50, and a second element 20 including an end face 21 bearing a pattern such as a logo or a trademark, the second element 20 being mounted such that it can move in rotation about an axis passing through the centre of the watch case.

The first element 10 is intended to be screwed onto the watch case 50 and has, for this purpose, on the rear face thereof, i.e. the face oriented inwards relative to the case, an annular shoulder 11 comprising a threading 110 on the outer circumference thereof. The shoulder 11 thus screws onto the bottom of the watch case 50 which comprises a complementary threading provided for this purpose.

The first element 10 further comprises, on the front face thereof, i.e. the face oriented outwards relative to the case, a base 12 with a wall 13 inclined outwards relative to the case such that said base 12 has a substantially trapezoid-shaped cross-section.

The second element 20 comprises a cavity 22 with a complementary inclined wall 23 at the base 12 in order to be able to forcibly interlock or clip, and thus assemble, the two elements 10, 20. In order to facilitate the forced introduction of the second element 20 on the first element 10, the rims of the base 12 and of the cavity 22 are bevelled.

Advantageously, the base 12 of the first element 10 comprises recessed portions 13' and an annular slot 13" formed behind the wall 13 so as to facilitate the deformation of the wall during the forced interlocking of the second element 20 onto the first element 10.

As can be observed, the diameter of the base 12 and of the cavity 22 are less than the diameters of the first and second elements 10, 20.

The second element 20 is mounted such that it can move in rotation on the first element 10 about the rotational axis C passing through the centre of the case 100, the interlocking or the clipping providing sufficient clearance to cause the second element 20 to pivot.

Figure 2A:
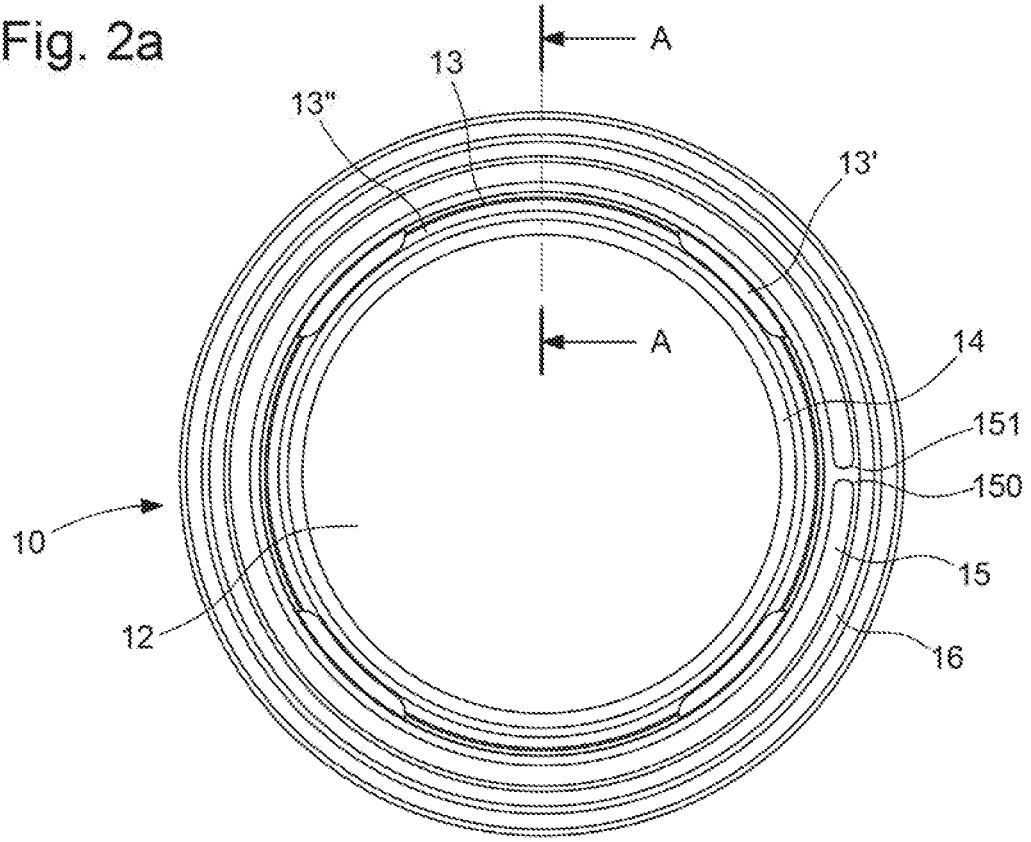
FIGS. 2*a* and 2*b* are respectively a view from below and a sectional view of the first element of a back according to the invention.
Figure 2B:
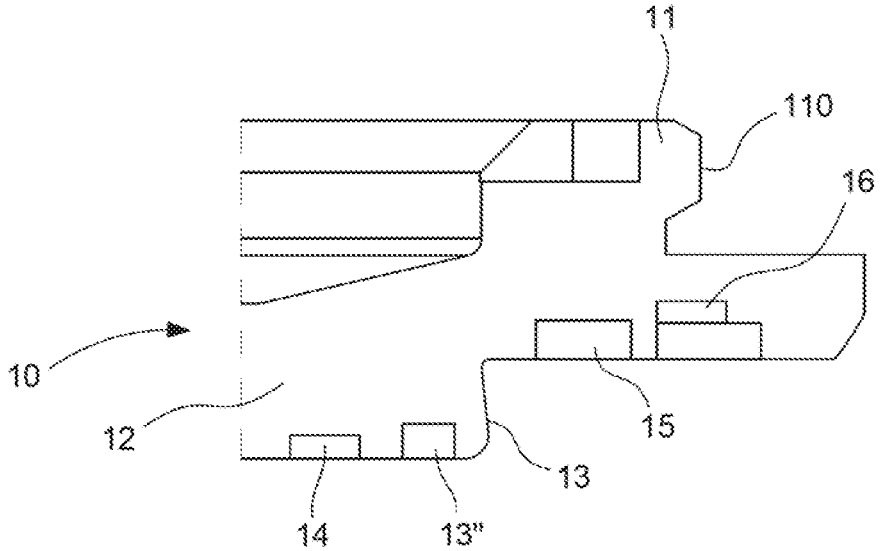
Figure 3A:
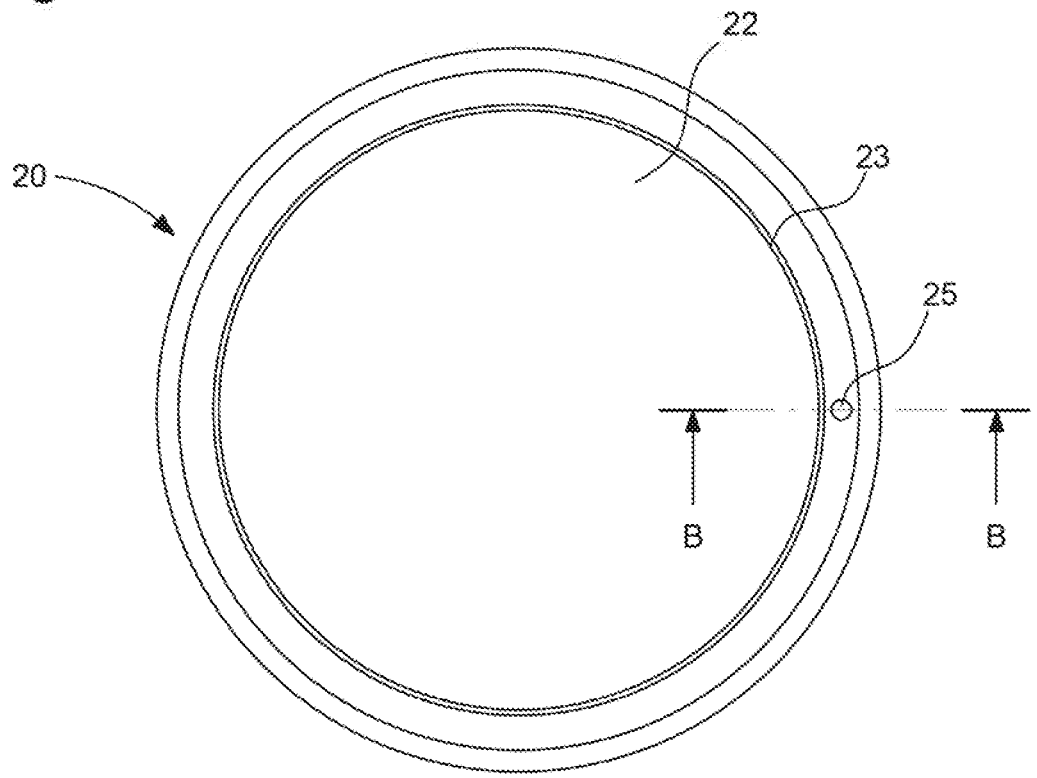
FIGS. 3*a* and 3*b* are respectively a view from below and a sectional view of the second element of a back according to the invention.
Figure 3B:
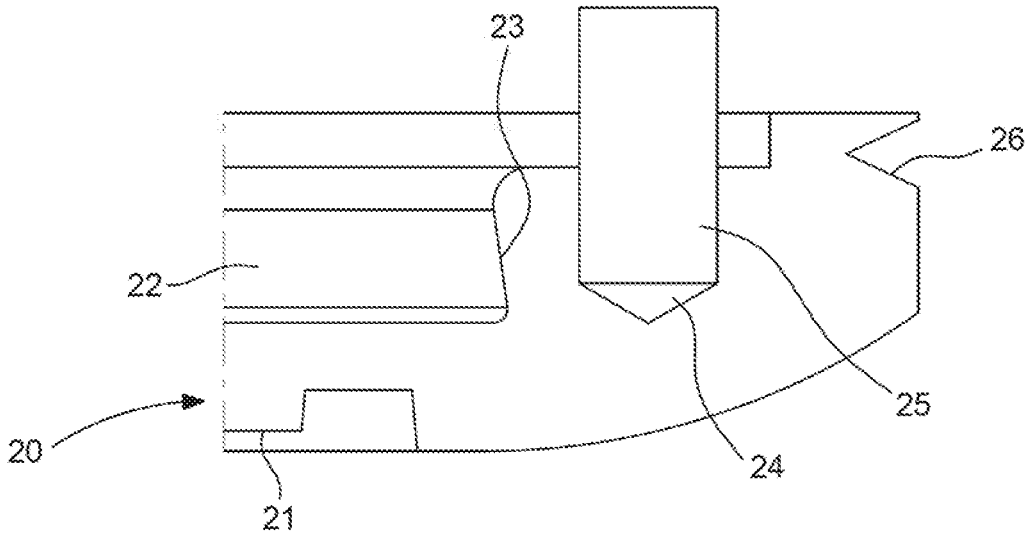
Figure 4:
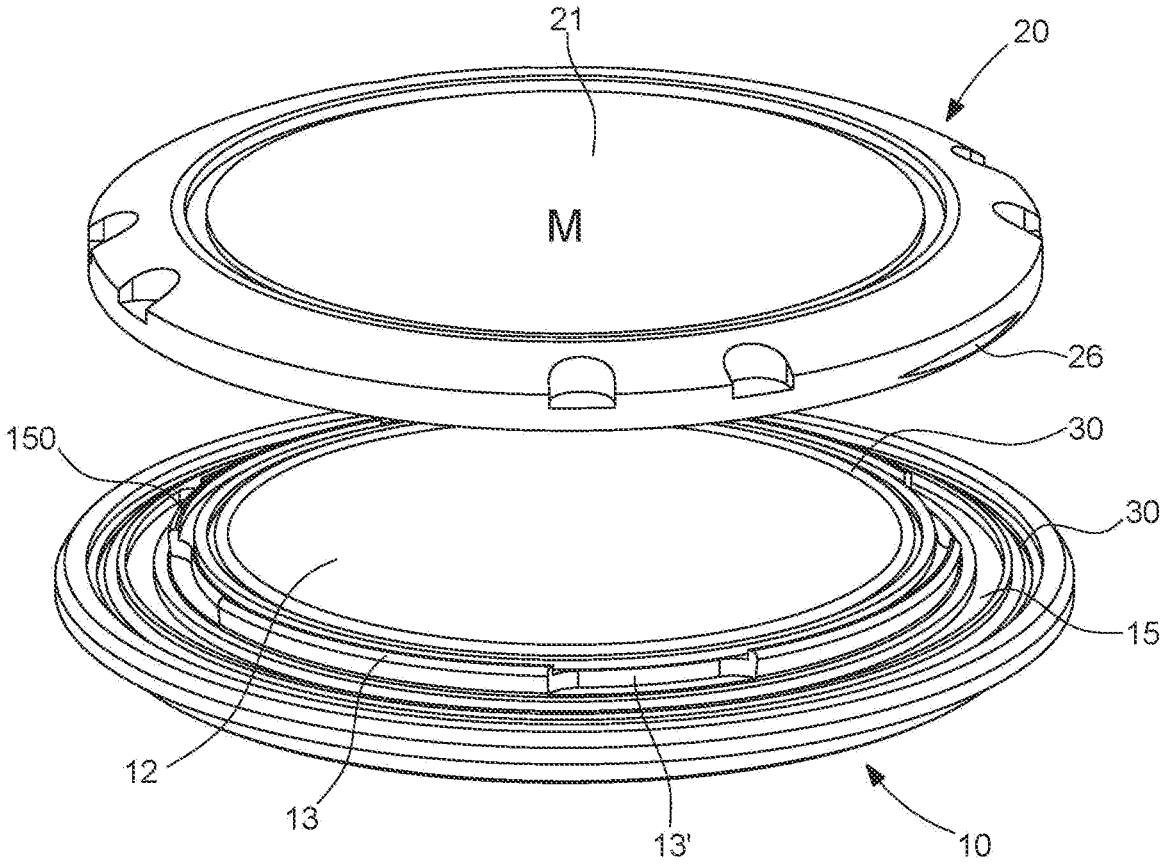
FIG. 4 is an exploded, perspective view of a back according to the invention.

As can be seen in FIGS. 2*a* and 2*b*, the first element 10 successively comprises a first annular slot 14 formed in the base 12, an annular groove 15 formed in the vicinity of the circumference of the first element and a second annular slot 16 also formed in the immediate vicinity of the circumference of the first element 10.

It can be seen in FIG. 1 that the second element 20 has an orifice 24 arranged so as to receive a pin 25, the pin 25 engaging with the annular groove 15 made in the first element 10 so as to guide the second element 20 during the pivoting thereof. It can also be seen in FIG. 2*a* that the annular groove 15 is not continuous and has two ends 150 and 151 close to one another, each defining a banking.

According to the invention, braking means are provided, which act by friction and which are arranged so as to hold different angular orientations of the second element 20 relative to the first element 10, and thus relative to the middle part. Thus, when the first element 10 is screwed such that it abuts against the middle part, the second element bearing the pattern M can be easily displaced angularly into a desired position against the frictional force generated by the braking means and held in the desired position. The second element 20 is thus axially clamped between the rear face thereof and the front face of the first element 10. Preferably, the respective dimensions of the second element 20, in particular the thickness thereof, and those of the first element 10 are chosen such that the edge of the second element 20 lies flush with the front face of the first element 10 in order to thus form a continuous surface.

According to one preferred embodiment, the braking means comprise at least one elastic annular element 30 which in particular has an elasticity in a direction parallel to the rotational axis C. Typically, the annular element can be formed by a gasket made of a natural or synthetic compressible material. The annular element 30 is disposed between the first element and the second element. According to the invention, the one or more elastic annular elements 30 are disposed in the first and second annular slots 14 and 16 which are made in the front face of the first element. A person skilled in the art could, without particular difficulty, reverse this assembly and place the elastic annular elements 30 on the rear face of the second element 20, having previously formed the slots 14 and 16 therein. The annular slots 14 and 16 are disposed on either side of the annular groove 15, which allows for better distribution of the friction forces generated by the elastic annular elements 30.

Advantageously, the second annular slot 16 has two levels, a first level forming the bottom of the slot arranged so as to receive an elastic annular element 30, and a second level forming the opening of the slot arranged so as to receive the edge of the second element 20. The second level has dimensions that are greater than those of the first level such that the edge of the second element 20 can undergo translational displacement in the direction of the axis C.

It should be noted that the desired braking force can be controlled by adapting the compression ratio of the annular element during manufacture.

It should also be noted that the use of a second element mounted on a first element enables the manufacturer to procure a stock of replacement backs as well as to use backs bearing different patterns. This type of back further allows various materials to be easily combined in order to produce the various elements thereof.

Thus, in order to orient the back, the manufacturer (or the wearer) exerts pressure on the second element 20 towards the watch case so as to compress the elastic annular elements 30. Then, while maintaining pressure on the second element, the manufacturer pivots the second element relative to the first element 10 so as to orient the back into a desired angular position such that the pattern M is, for example, aligned with the 6 o'clock-12 o'clock axis of the watch.

In order to facilitate the disassembly of the second element 20 from the first element 10, the second element 20 comprises a notch 26 capable of receiving a tool for exerting leverage and thus for dislodging the second element.

The timepiece 100, for example of the wristwatch type, provided with the back 1 according to the invention, is partially shown in FIG. 1. This timepiece in particular comprises a middle part 51 positioned underneath a bezel 52 which can be screwed onto the middle part 51 and which is used to hold a crystal 53. The assembly formed by the bezel 52 and the crystal 53 is sealed by the insertion of a gasket 54. The middle part 51 further has a boring for the passage of a rod 55 onto which a winding button 56 is fastened. In the example shown in the figures, the wristwatch is of the analogue time display type and comprises, for this purpose, a set of hour and minute hands 58 (only one hand is shown in the drawing) moving over a dial 57. It goes without saying that the present invention could also apply to a digital time display watch comprising, for example, a liquid crystal cell.

It is understood that various modifications and/or improvements that would be obvious to a person skilled in the art can be made to the embodiment described herein, while still remaining within the scope of the present invention as defined by the accompanying claims. In particular, the use of an undulated spring ring instead of the ring gasket 30 could be considered, provided that it has compressible elasticity along the axis C. In yet another alternative embodiment, the braking means could be associated with indexing notches in order to position the substrate in a plurality of predefined angular positions.

It should be noted that an O-ring 31 is conventionally inserted into an annular groove 59 made in the bottom of the middle part 51 in order to guarantee sealing between the first element 10 of the back 1 and said middle part 51.

The first element and the second element can be made of metals, a metal alloy, ceramic, composite material or plastics material.

It goes without saying that the invention is not limited to the embodiment described above and that various simple alternatives and modifications can be considered while still remaining within the scope of the invention.

The invention claimed is:

1. A back (1) for a watch case (50), the back (1) comprising:

a first element (10) arranged so as to be screwed onto the watch case (50); and a second element (20) including an end face bearing a pattern (M), the second element (20) being mounted such that the second element can move in rotation about an axis (C) passing through the centre of the case (50), wherein the second element (20) comprises braking means arranged so as to hold same relative to the first element (10) in different angular positions about the rotational axis (C), the braking means being disposed between the first and second elements (10, 20), and wherein the first element (10) comprises a wall (13) inclined outwards relative to the case arranged to cooperate with a cavity (22) formed in the second element (20), the cavity (22) comprising a complementary inclined wall (23) configured to forcibly interlock or clip, and assemble the first and second elements (10, 20).

2. The back for a watch case according to claim 1, wherein said braking means act by friction.

3. The back for a watch case according to claim 1, wherein said braking means include at least one elastic annular element (30).

4. The back for a watch case according to claim 1, wherein said at least one annular element (30) is elastic in a direction parallel to the rotational axis (C) of the second element (20).

5. The back for a watch case according to claim 1, wherein said braking means are formed by a ring gasket (30) made of a compressible material.

6. The back for a watch case according to claim 1, wherein the first element (10) and the second element (20) comprise complementary clipping means.

7. The back for a watch case according to claim 1, wherein the second element (20) comprises a pin (24) arranged such that it engages with an annular groove (15) formed in the first element (10).

8. The back for a watch case according to claim 3, wherein the second element (20) comprises two elastic annular elements (30) housed inside first and second annular slots (14, 16) facing one another and formed in the first element (10).

9. The back for a watch case according to claim 8, wherein said annular slots (14, 16) are disposed on either side of the annular groove (15).

10. The back for a watch case according to claim 8, wherein the second annular slot (16) has two levels, a first level forming the bottom and arranged so as to receive an elastic annular element (30), and a second level arranged so as to receive the edge of the second element (20).

11. The back for a watch case according to claim 1, wherein an O-ring (31) is inserted into an annular groove (59) made in the bottom of the watch case (51) in order to guarantee sealing between the back (1) and said case (50).

12. A timepiece comprising a back for the watch case according to claim 1.

* * * * *